US010849355B2

(12) United States Patent
Bachman

(10) Patent No.: US 10,849,355 B2
(45) Date of Patent: Dec. 1, 2020

(54) SMOKELESS TOBACCO SUBSTITUTE

(71) Applicant: Stephen E. Bachman, Amarillo, TX (US)

(72) Inventor: Stephen E. Bachman, Amarillo, TX (US)

( * ) Notice: Subject to any disclaimer, the term of this patent is extended or adjusted under 35 U.S.C. 154(b) by 358 days.

(21) Appl. No.: 16/005,243

(22) Filed: Jun. 11, 2018

(65) Prior Publication Data

US 2019/0373943 A1 Dec. 12, 2019

(51) Int. Cl.
*A24B 15/26* (2006.01)
*A24B 15/16* (2020.01)
*A24B 15/24* (2006.01)

(52) U.S. Cl.
CPC ..... *A24B 15/16* (2013.01); *A24B 15/24* (2013.01)

(58) Field of Classification Search
CPC ..... A24B 15/24; A24B 15/18; A24B 15/16; A24B 15/10; A24B 15/00; A61K 36/899
USPC ..... 131/359, 347; 424/750
See application file for complete search history.

(56) References Cited

U.S. PATENT DOCUMENTS

| | | | | |
|---|---|---|---|---|
| 8,999,405 | B1 * | 4/2015 | Bachman | A61K 31/047 424/725 |
| 2004/0123873 | A1 * | 7/2004 | Calandro | A24B 15/16 131/359 |
| 2012/0031415 | A1 * | 2/2012 | Essen | A23L 33/22 131/275 |
| 2015/0045543 | A1 * | 2/2015 | Mitchell | C08B 37/0057 530/500 |
| 2015/0223517 | A1 * | 8/2015 | Hearn | A24B 15/16 131/298 |

* cited by examiner

*Primary Examiner* — Michael H. Wilson
*Assistant Examiner* — Yana B Krinker
(74) *Attorney, Agent, or Firm* — Grossman, Tucker, Perreault & Pfleger, PLLC

(57) ABSTRACT

A method to prepare a smokeless tobacco substitute, the method including providing a first amount of commercial corn husk biomass, treating the commercial corn husk biomass with strong base to form treated corn husk biomass, removing water soluble materials from the treated corn husk biomass, and collecting a second amount of solids having a dry matter of about twenty-five percent (25%) for use as a smokeless tobacco substitute.

10 Claims, 3 Drawing Sheets

Proportions of the corn plant at maturity (by weight). Pordesano et al., 2004

Figure 1. Proportions of the corn plant at maturity (by weight). Pordesimo et al., 2004

SMOKELESS TOBACCO SUBSTITUTE

FIELD OF THE INVENTION

Applicant's disclosure is directed to a smokeless tobacco substitute, and a method to prepare same.

BACKGROUND

Tobacco smoking is known to be linked with serious respiratory, heart, and neoplastic diseases. In 2010, the United States Surgeon General reported that annually, approximately one in every five deaths (443,000) in the United States was due to cigarettes. A large proportion of these deaths were caused by early heart attacks, chronic lung diseases, and cancers, which impose an economic burden of about $193 billion, annually, in health care costs and loss of productivity.

Tobacco smoke is an extremely complex mixture of about 6000 chemical compounds, which can be divided into two phases: a particulate phase, which is commonly called tar; and a vapor phase, which contains gases and semi-volatile compounds. About 4800 compounds have been identified in the tar portion of cigarette smoke and about 69 of these have been identified as carcinogens.

At least 28 chemicals in smokeless tobacco have been found to cause cancer. The most harmful chemicals in smokeless tobacco are tobacco-specific nitrosamines, which are formed during the growing, curing, fermenting, and aging of tobacco. The level of tobacco-specific nitrosamines varies by product. Scientists have found that nitrosamine level is directly related to the risk of cancer. In addition, using smokeless tobacco may also cause heart disease, gum disease, and oral lesions.

Despite the dangers, many people persist in using tobacco products because of their addiction to nicotine, which constitutes about 0.6-3.0% of the dry weight of tobacco. In fact, nicotine dependence is higher than that of any other substance abuse disorder.

It would, therefore, be desirable to have a tobacco substitute that satiates a nicotine craving while minimizing exposure to the harmful compounds found in tobacco.

SUMMARY OF THE INVENTION

A method to prepare a smokeless tobacco substitute, comprising providing a first amount of commercial corn husk biomass, treating that commercial corn husk biomass with strong, aqueous base to form treated corn husk biomass, removing water-soluble materials from the treated corn husk biomass, and collecting a second amount of solids having a dry matter of about twenty-five percent (25%) for use as a smokeless tobacco substitute.

BRIEF DESCRIPTION OF THE DRAWINGS

Applicant's disclosure will be better understood from a reading of the following detailed description taken in conjunction with the drawings in which like reference designators are used to designate like elements, and in which.

DETAILED DESCRIPTION OF THE PREFERRED EMBODIMENTS

Applicant's smokeless tobacco substitute, and method to prepare same, is described in preferred embodiments in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of Applicant's disclosure may be combined in any suitable manner in one or more embodiments. In the following description, numerous specific details are recited to provide a thorough understanding of embodiments of the invention. One skilled in the relevant art will recognize, however, that Applicant's disclosure may be practiced without one or more of the specific details, or with other methods, components, materials, and so forth. In other instances, well-known structures, materials, or operations are not shown or described in detail to avoid obscuring aspects of Applicant's disclosure, and it will be appreciated by those skilled in the art that it is intended to cover alternatives, modifications, and equivalents as may be included within the spirit and scope of Applicant's disclosure as defined by the appended claims and their equivalents as supported by the following disclosure and drawings.

Figure 1A:
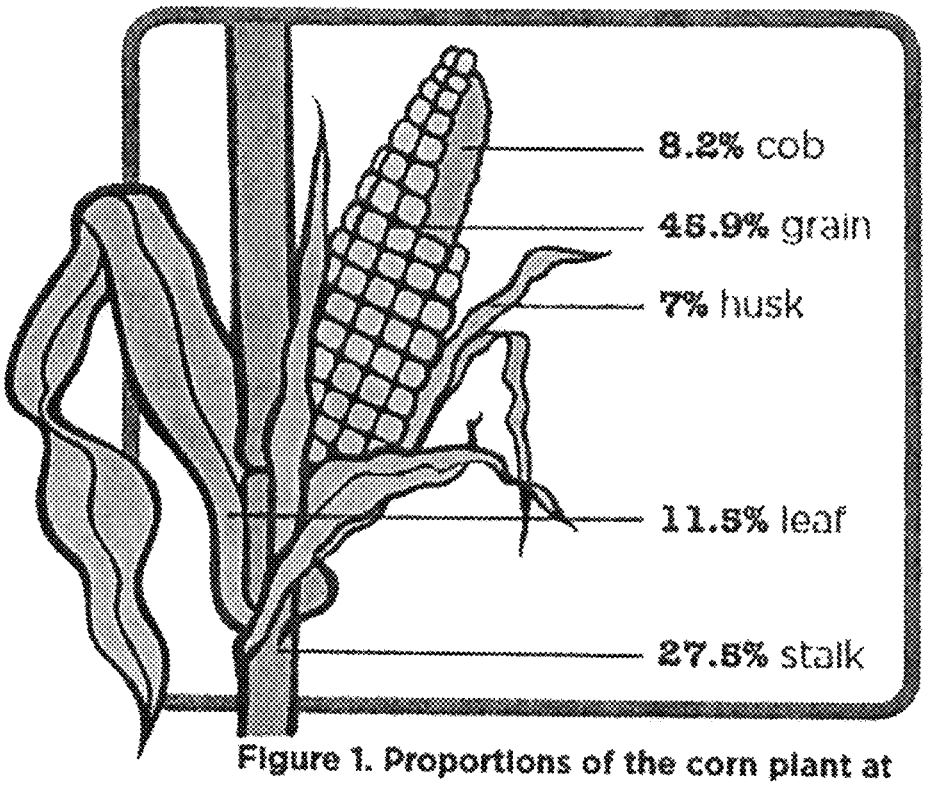
FIG. 1A illustrates the portions by weight of a mature corn plant.

FIG. 1 illustrates the proportions of a corn plant at maturity. Referring now to FIG. 1, corn husk material comprises about seven weight percent (7 wt %) of a corn plant at maturity.

Cellulose 1 is present in corn husk biomass at about 31 weight percent to about 39 weight percent. It is a semicrystalline biopolymer of glucose molecules with beta (1-4) glycosidic linkage naturally organized as microfribrils, and has strong mechanical properties. In general, the mechanical properties of a natural fiber are influenced by its chemical composition, internal fiber structure, microfibril angle, cell dimensions and the presence of defects. The main function of cellulose in the plant cell is structural.

1

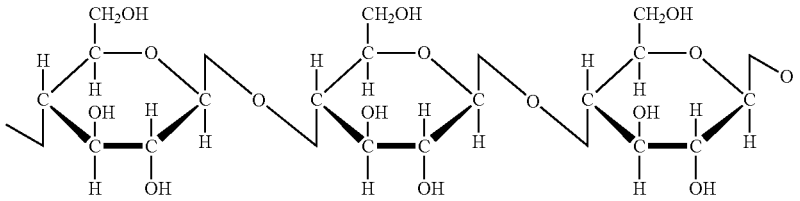

Hemicellulose 2 is present in corn husk biomass at a level between about 34 weight percent to about 41 weight percent. Hemicellulose 2 comprises an amorphous biopolymer with low molecular weight. Its backbone chain is primarily composed of xylan β(1 4)-linkages that include D-xylose and L-arabinose. Hemicellulose binds bundles of cellulose fibrils to form microfibrils and is also crosslinked with lignin, creating a complex network of bonds that provide structural strength and prevent microbial degradation of the plant. The portion of cellulose and hemicelluloses in the lignocellulosic material is named holocellulose.

2

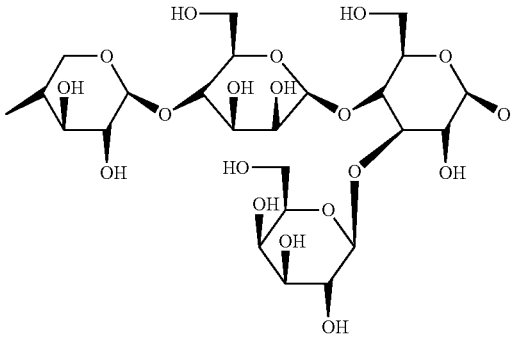

Lignin 3 is present in corn husk biomass at a level between about 2 weight percent and about 14 weight percent. Chemically, lignins are cross-linked phenolic polymers comprising a macromolecule that is composed of aliphatic and aromatic constituents. As a general matter, lignin is insoluble in water and alcohol but soluble in weak alkaline solutions. Its structure is very complex and consists of a three-dimensional randomized network. The main functions of lignin in the plant are to act as a biological barrier and a binder to retain hemicelluloses and celluloses in order to shape the cell walls.

3

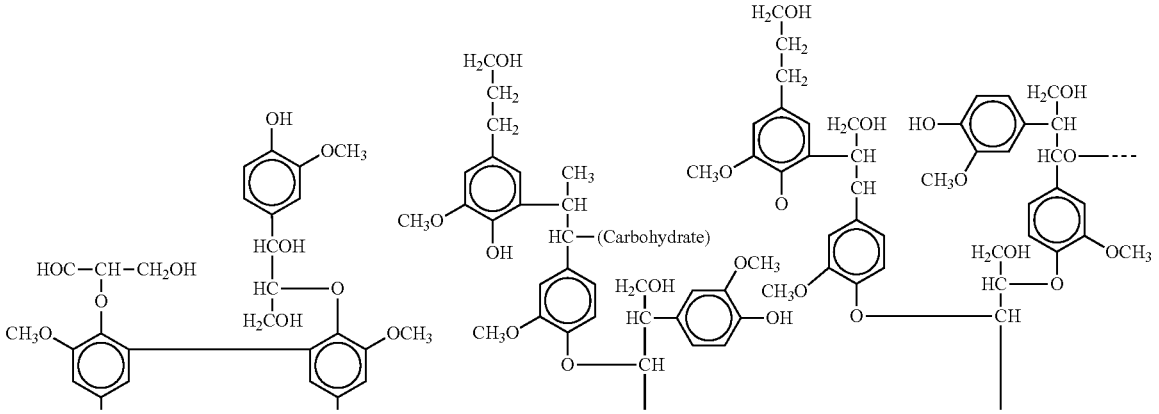

-continued

A significant fraction (45-78%) of the starting lignin-rich material can be depolymerized to low molecular weight, water-soluble species. These water soluble species include Syringol 4 and a mixture of ortho-, meta-, and para-, dihydroxybenzenes 5, i.e. a mixture of catechols.

4

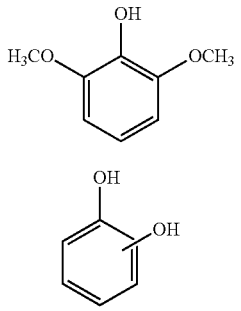

Figure 1B:
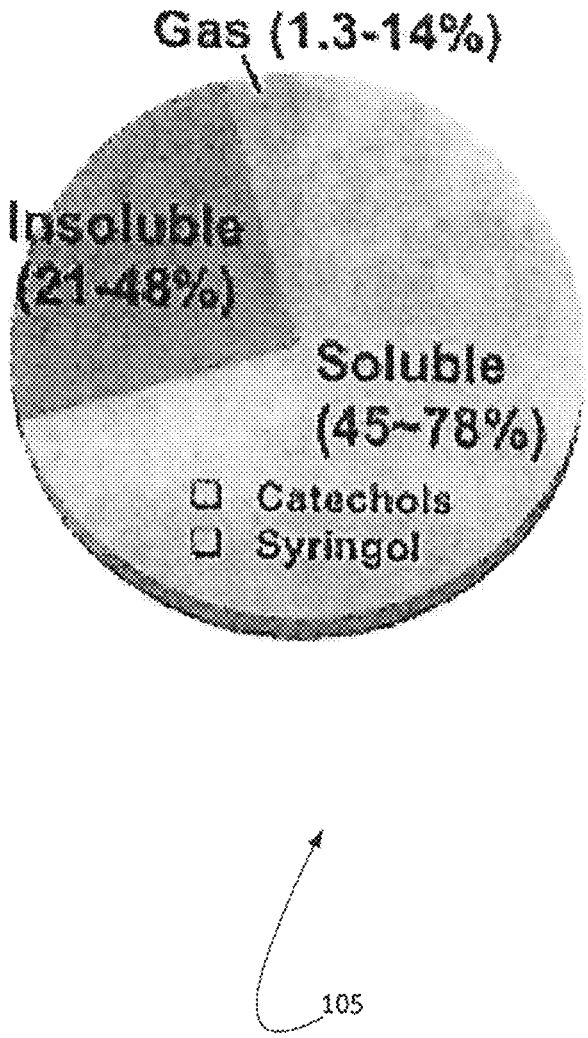
FIG. 1B recites the reaction products from Applicant's base-catalyzed depolymerization of lignins and cellulose.

FIG. 1B graphically summarizes the reaction products from Applicant's base-catalyzed depolymerization of a mixture of lignins and cellulose disposed in corn husk biomass.

Corn husk biomass further comprises "ash" at a level between about 3 and about 7 weight percent. "Ash" is defined to mean any and all inorganic materials disposed in the corn husk biomass. As those of skill in the art will appreciate, such inorganic materials are water-insoluble.

Corn husk biomass further comprises between about 10 and about 18 weight percent water soluble components. These water soluble materials include pectin 6 and gums.

6

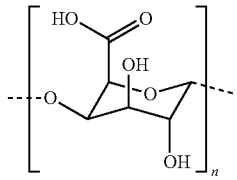

Figure 2:
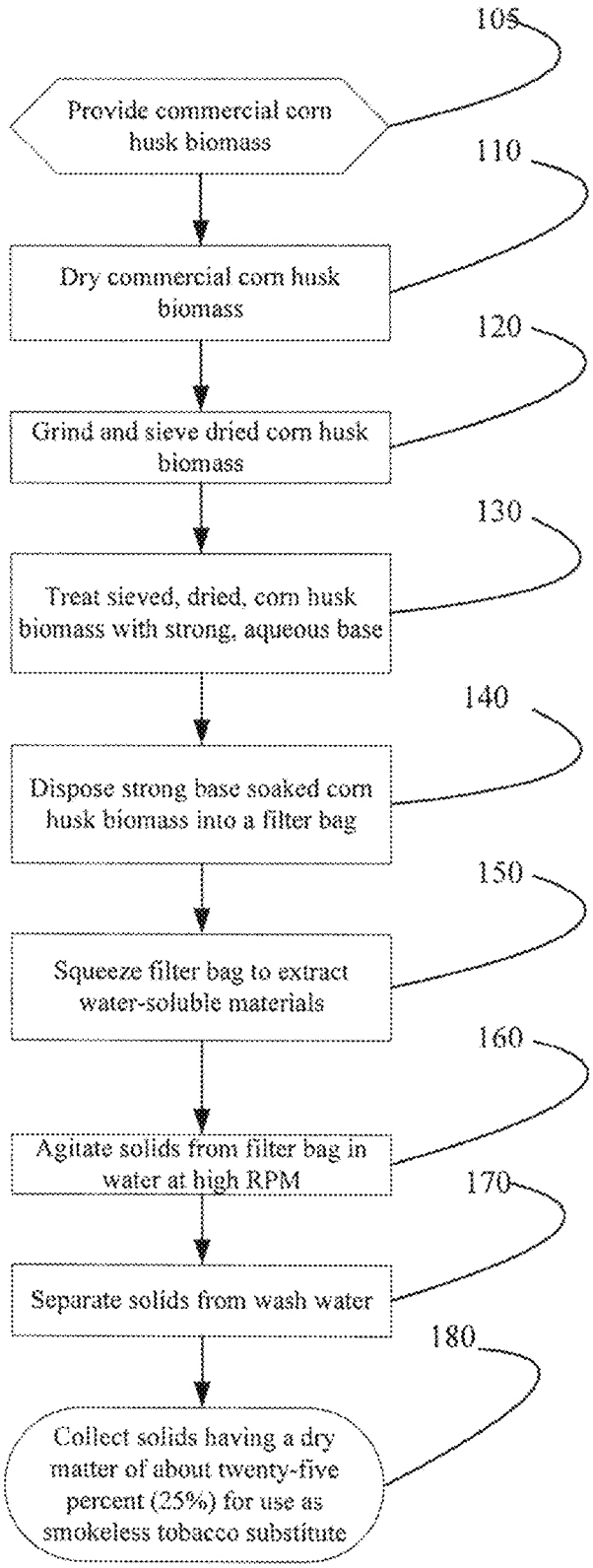
FIG. 2 summarizes the initial steps of Applicant's method.

FIG. 2 summarizes Applicant's method to prepare a smokeless tobacco substitute from commercially available corn husks, but includes any structural carbohydrate having a similar composition of cellulose, hemicellulose, and lignin (i.e. wheat straw). Referring now to FIG. 2, in step 105 the method provides commercially available corn husks. In step 120, the dried corn husks are ground and sieved.

Referring once again to FIG. 2, in step 130 the method treats the dried and sieved corn husk biomass with a ten weight percent (10 wt %) Sodium Hydroxide solution. Such a 10 weight percent solution of NaOH in water comprises a 2.5M solution.

In other embodiments, other bases are utilized, such as and without limitation, KOH; LiOH; NaH; R—O⁻M+, wherein R is selected from the group consisting of alkyl, phenyl, aralkyl, and wherein M+ is selected from the group consisting of Na+, Li+, K+, Ca++, Mg++, Ba++; and the like. In these embodiments, an aqueous solution having a pH of about 14 or greater are employed in step 130

In certain embodiments, the method in step 130 soaks the dried and sieved corn husk biomass with 2.5 M NaOH for four (4) to six (6) hours. Applicant has found that soaking for a time grater than six hours results in the biomass becoming too soft and mushy, thereby precluding use of the treated biomass to form an acceptable product. Applicant has also found that use of NaOH at a concentration lower than about 2.5 M results in a much less efficient depolymerization of the lignins/cellulose giving a much reduced yield of water-soluble reaction products.

Applicant's treatment of the sieved and dried corn husk biomass with 2.5 M NaOH effects a base-catalyzed depolymerization of both lignins and cellulose. FIG. 1B recites the reaction products resulting from Applicant's base-catalyzed depolymerization. After the treatment of step 130, the weight of the original corn husk material of step 105 has been reduced by about fifty percent (50%).

Referring once again to FIG. 2, in step 140 the method transfers the NaOH soaked corn husk biomass into a filter bag. In step 150, that filter bag is manually squeezed to remove the water and water-soluble materials. In step 160, the solids from the filter bag are agitated in water, then centrifuged at between about 2000 rpm to about 4000 rpm.

The resulting solids comprise a dry matter of about twenty-five percent (25%). These solids are utilized to prepare Applicant's Smokeless Tobacco Substitute.

While the preferred embodiments of the present invention have been illustrated in detail, it should be apparent that modifications and adaptations to those embodiments may occur to one skilled in the art without departing from the scope of Applicant's disclosure.

I claim:

1. A method to prepare a smokeless tobacco substitute, comprising:

providing a first amount of commercial corn husk biomass;

treating said commercial corn husk biomass with sodium hydroxide to form treated corn husk biomass;

removing water-soluble materials from said treated corn husk biomass; and collecting a second amount of solids having a dry matter of about twenty-five percent (25%) for use as a smokeless tobacco substitute.

2. The method of claim 1, wherein said second amount of solids comprises about fifty percent (50%) of the first amount of commercial corn husk biomass.

3. The method of claim 1, wherein:

said commercial corn husk biomass comprises water-insoluble lignins at up to about 14 weight percent;

said treatment with sodium hydroxide effects a depolymerization of said lignins to form a first plurality of water-soluble compounds including Syringol and a mixture of catechols.

4. The method of claim 3, wherein said commercial corn husk biomass further comprises cellulose, said method further comprising depolymerizing said cellulose to form a second plurality of water soluble compounds.

5. The method of claim 4, wherein said plurality of water-soluble compounds further includes pectin.

6. The method of claim 5, wherein said plurality of water soluble compounds further includes one or more gums.

7. The method of claim 1, further comprising:

after said providing and before said treating, drying said commercial corn husk biomass; and after said drying and before said treating, grinding and sieving said dried commercial corn husk biomass.

8. The method of claim 7, further comprising soaking the dried and sieved commercial corn husk biomass in a ten weight percent aqueous solution of Sodium Hydroxide.

9. The method of claim 8, further comprising continuing said soaking for at least four (4) hours.

10. The method of claim 9, further comprising continuing said soaking for not more than six (6) hours.

* * * * *